US005682014A

United States Patent [19]

Highsmith et al.

[11] Patent Number: 5,682,014

[45] Date of Patent: Oct. 28, 1997

[54] BITETRAZOLEAMINE GAS GENERANT COMPOSITIONS

[75] Inventors: Thomas K. Highsmith, North Ogden; Reed J. Blau, Richmond; Gary K. Lund, Ogden, all of Utah

[73] Assignee: Thiokol Corporation, Ogden, Utah

[21] Appl. No.: 101,396

[22] Filed: Aug. 2, 1993

[51] Int. Cl.[6] ..... C06B 47/08

[52] U.S. Cl. ..... 149/36; 149/37; 149/46; 149/61; 149/76; 149/77; 149/109.2; 149/18; 286/741

[58] Field of Search ..... 149/36, 37, 109.2, 149/61, 77, 46, 76, 18

[56] References Cited

U.S. PATENT DOCUMENTS

| | | | |
|---|---|---|---|
| 2,981,616 | 4/1961 | Boyer | 52/5 |
| 3,122,462 | 2/1964 | Kaufman et al. | 149/35 |
| 3,468,730 | 9/1969 | Gawlick et al. | 149/61 |
| 3,674,059 | 7/1972 | Stephenson | 141/4 |
| 3,719,604 | 3/1973 | Prior et al. | 252/186 |
| 3,739,574 | 6/1973 | Godfrey | 60/39.03 |
| 3,773,351 | 11/1973 | Catanzarite | 280/150 AB |
| 3,773,352 | 11/1973 | Radke | 280/150 AB |
| 3,773,947 | 11/1973 | Boyars et al. | 423/351 |
| 3,775,182 | 11/1973 | Marshall | 252/188.3 |
| 3,778,084 | 12/1973 | Sutherland et al. | 280/150 AB |
| 3,779,823 | 12/1973 | Price et al. | 149/19 |
| 3,785,149 | 1/1974 | Timmerman | 60/205 |
| 3,787,074 | 1/1974 | Lewis et al. | 280/150 AB |
| 3,791,302 | 2/1974 | McLeod | 102/70.2 |
| 3,806,461 | 4/1974 | Hendrickson et al. | 252/188.3 R |
| 3,833,029 | 9/1974 | Munn | 141/4 |
| 3,833,432 | 9/1974 | Moy et al. | 149/19.3 |
| 3,845,970 | 11/1974 | Herrman | 280/741 |
| 3,862,866 | 1/1975 | Timmerman et al. | 149/21 |
| 3,868,124 | 2/1975 | Johnson | 280/150 AB |
| 3,880,447 | 4/1975 | Thorn et al. | 280/150 AB |
| 3,880,595 | 4/1975 | Timmerman | 23/281 |
| 3,883,373 | 5/1975 | Sidebottom | 149/6 |
| 3,895,098 | 7/1975 | Pietz | 423/351 |
| 3,897,235 | 7/1975 | Hamilton et al. | 149/41 |
| 3,898,112 | 8/1975 | Strecker et al. | 149/19.9 |
| 3,902,934 | 9/1975 | Timmerman | 149/83 |
| 3,912,458 | 10/1975 | Fukuma et al. | 23/281 |
| 3,912,561 | 10/1975 | Doin et al. | 149/35 |
| 3,912,562 | 10/1975 | Garner | 149/41 |
| 3,931,040 | 1/1976 | Breazcale | 252/188.3 R |
| 3,933,543 | 1/1976 | Madden | 149/21 |
| 3,934,984 | 1/1976 | Marlow et al. | 23/281 |
| 3,936,330 | 2/1976 | Dergazarian et al. | 149/35 |

(List continued on next page.)

FOREIGN PATENT DOCUMENTS 0519 485 A1 12/1992 European Pat. Off. ..... C06D 5/06

OTHER PUBLICATIONS

W.P. Norris and R.A. Henry, "Cyanoguanyl Azide Chemistry," Mar. pp. 650–660, 1964.

"5–Aminotetrazole," *10–Organic Chemistry*, vol. 23, p. 4471, 1929.

R. Stollé et al., "Zur Kenntnis des Amino–5–tetrazols," Jahrg. 62, pp. 1118–1127, 1929.

*Primary Examiner*—Edward A. Miller

*Attorney, Agent, or Firm*—Cushman Darby & Cushman IP Group of Pillsbury Madison & Sutro, LLP; Ronald L. Lyons, Esq.

[57] ABSTRACT

A solid composition for generating a nitrogen containing gas is provided. The composition includes an oxidizer and a non-azide fuel selected from a bitetrazoleamine or a derivative or a salt or complex thereof and mixtures thereof. The preferred bitetrazole-amine is bis-(1(2)H-tetrazol-5-yl)-amine, a metal salt, a salt with a nonmetallic cation of a high nitrogen content base or a complex thereof. The salts and complexes are generally metal salts and complexes. The metal can be a transition metal. Metals that have been found to be particularly useful include copper, boron, cobalt, zinc, potassium, sodium, and strontium. The oxidizer is generally a metal oxide or a metal hydroxide. The composition can include certain other components such as secondary oxidizers, burn rate modifiers, slag formers, and binders.

34 Claims, 3 Drawing Sheets

U.S. PATENT DOCUMENTS

| | | | |
|---|---|---|---|
| 3,940,298 | 2/1976 | Beckert et al. | 149/92 |
| 3,947,300 | 3/1976 | Passauer et al. | 149/35 |
| 3,964,255 | 6/1976 | Catanzarite | 60/205 |
| 3,971,729 | 7/1976 | Timmerman | 252/187 R |
| 3,996,079 | 12/1976 | Divalentin | 149/35 |
| 4,021,275 | 5/1977 | Kishi et al. | 149/35 |
| 4,062,708 | 12/1977 | Goetz | 149/35 |
| 4,114,591 | 9/1978 | Nakagawa | 126/263 |
| 4,128,996 | 12/1978 | Garner et al. | 60/205 |
| 4,142,029 | 2/1979 | Illy | 521/95 |
| 4,152,891 | 5/1979 | Garner | 60/205 |
| 4,157,648 | 6/1979 | Brennan et al. | 60/205 |
| 4,179,327 | 12/1979 | Seldner | 156/667 |
| 4,200,615 | 4/1980 | Hamilton et al. | 422/166 |
| 4,203,786 | 5/1980 | Garner | 149/19.91 |
| 4,203,787 | 5/1980 | Kirchoff et al. | 149/35 |
| 4,214,438 | 7/1980 | Hamilton et al. | 60/205 |
| 4,238,253 | 12/1980 | Garner | 149/19 |
| 4,244,758 | 1/1981 | Garner et al. | 149/7 |
| 4,246,051 | 1/1981 | Garner et al. | 149/7 |
| 4,298,412 | 11/1981 | Biddle et al. | 149/19.5 |
| 4,306,499 | 12/1981 | Holmes | 102/202.4 |
| 4,339,288 | 7/1982 | Camp | 149/8 |
| 4,369,079 | 1/1983 | Shaw | 149/2 |
| 4,370,181 | 1/1983 | Lundstrom et al. | 149/2 |
| 4,370,930 | 2/1983 | Strasser et al. | 102/530 |
| 4,376,002 | 3/1983 | Utracki | 149/35 |
| 4,386,979 | 6/1983 | Jackson | 149/21 |
| 4,390,380 | 6/1983 | Camp | 149/8 |
| 4,407,119 | 10/1983 | Biddle et al. | 60/219 |
| 4,414,902 | 11/1983 | Strasser et al. | 102/531 |
| 4,424,086 | 1/1984 | Christopher | 149/19.3 |
| 4,533,416 | 8/1985 | Poole | 149/35 |
| 4,547,235 | 10/1985 | Schneiter et al. | 149/35 |
| 4,547,342 | 10/1985 | Adams et al. | 422/166 |
| 4,578,247 | 3/1986 | Bolieau | 422/165 |
| 4,590,860 | 5/1986 | Kromrey | 102/289 |
| 4,604,151 | 8/1986 | Knowlton et al. | 149/35 |
| 4,608,102 | 8/1986 | Krampen et al. | 149/92 |
| 4,664,033 | 5/1987 | Burkdoll et al. | 102/275.2 |
| 4,696,705 | 9/1987 | Hamilton | 149/21 |
| 4,698,107 | 10/1987 | Goetz et al. | 149/7 |
| 4,699,400 | 10/1987 | Adams et al. | 280/731 |
| 4,734,141 | 3/1988 | Cartwright et al. | 149/35 |
| 4,758,287 | 7/1988 | Pietz | 149/2 |
| 4,798,142 | 1/1989 | Canterberry et al. | 102/290 |
| 4,806,180 | 2/1989 | Goetz et al. | 149/5 |
| 4,833,996 | 5/1989 | Hayashi et al. | 102/530 |
| 4,834,817 | 5/1989 | Zeuner et al. | 149/35 |
| 4,834,818 | 5/1989 | Kazumi et al. | 149/35 |
| 4,865,667 | 9/1989 | Zeuner et al. | 149/22 |
| 4,890,860 | 1/1990 | Schneiter | 280/741 |
| 4,909,549 | 3/1990 | Poole et al. | 280/738 |
| 4,919,897 | 4/1990 | Bender et al. | 422/165 |
| 4,931,111 | 6/1990 | Poole et al. | 149/35 |
| 4,931,112 | 6/1990 | Wardle et al. | 149/88 |
| 4,948,439 | 8/1990 | Poole et al. | 149/46 |
| 4,950,458 | 8/1990 | Cunningham | 422/164 |
| 4,959,011 | 9/1990 | Nilsson | 431/263 |
| 4,981,534 | 1/1991 | Scheffe | 149/19.91 |
| 4,982,664 | 1/1991 | Norton | 102/272 |
| 4,998,751 | 3/1991 | Paxton et al. | 280/741 |
| 5,003,887 | 4/1991 | Unterforsthuber et al. | 102/531 |
| 5,004,586 | 4/1991 | Hayashi et al. | 422/164 |
| 5,005,486 | 4/1991 | Lenzen | 102/531 |
| 5,015,311 | 5/1991 | Ramaswamy | 149/42 |
| 5,019,192 | 5/1991 | Ramaswamy | 149/42 |
| 5,019,220 | 5/1991 | Taylor et al. | 264/3.4 |
| 5,022,674 | 6/1991 | Frantom et al. | 280/741 |
| 5,024,160 | 6/1991 | Canterberry et al. | 102/323 |
| 5,031,932 | 7/1991 | Frantom et al. | 280/741 |
| 5,033,390 | 7/1991 | Minert et al. | 102/530 |
| 5,035,757 | 7/1991 | Poole | 149/46 |
| 5,043,030 | 8/1991 | Ramaswany | 149/16 |
| 5,046,429 | 9/1991 | Swann et al. | 102/530 |
| 5,052,817 | 10/1991 | Bement et al. | 374/8 |
| 5,062,365 | 11/1991 | Canterberry | 102/322 |
| 5,062,367 | 11/1991 | Hayashi et al. | 102/530 |
| 5,073,273 | 12/1991 | Gupta et al. | 210/760 |
| 5,074,940 | 12/1991 | Ochi et al. | 149/35 |
| 5,084,118 | 1/1992 | Poole | 149/22 |
| 5,089,069 | 2/1992 | Ramaswamy et al. | 149/21 |
| 5,094,475 | 3/1992 | Olsson et al. | 280/741 |
| 5,098,597 | 3/1992 | Rothgery et al. | 252/182.34 |
| 5,100,174 | 3/1992 | Jasken et al. | 280/741 |
| 5,104,466 | 4/1992 | Allard et al. | 149/21 |
| 5,139,588 | 8/1992 | Poole | 149/61 |
| 5,197,758 | 3/1993 | Lund et al. | 280/741 |
| 5,212,343 | 5/1993 | Brupbacher et al. | 102/323 |

BITETRAZOLEAMINE GAS GENERANT COMPOSITIONS

FIELD OF THE INVENTION

The present invention relates to a novel gas generating composition for inflating automobile air bags and similar devices. More particularly, the present invention relates to the use of a bitetrazoleamine, such as bis-(1(2)H-tetrazol-5-yl)-amine, and derivatives thereof, as a primary fuel in gas generating pyrotechnic compositions.

BACKGROUND OF THE INVENTION

Gas generating chemical compositions are useful in a number of different contexts. One important use for such compositions is in the operation of "air bags." Air bags are gaining in acceptance to the point that many, if not most, new automobiles are equipped with such devices. Indeed, many new automobiles are equipped with multiple air bags to protect the driver and passengers.

In the context of automobile air bags, sufficient gas must be generated to inflate the device within a fraction of a second. Between the time the car is impacted in an accident, and the time the driver would otherwise be thrust against the steering wheel, the air bag must fully inflate. As a consequence, nearly instantaneous gas generation is required.

There are a number of additional important design criteria that must be satisfied. Automobile manufacturers and others set forth the required criteria which must be met in detailed specifications. Preparing gas generating compositions that meet these important design criteria is an extremely difficult task. These specifications require that the gas generating composition produce gas at a required rate. The specifications also place strict limits on the generation of toxic or harmful gases or solids. Examples of restricted gases include carbon monoxide, carbon dioxide, NOx, SOx, and hydrogen sulfide.

The automobile manufacturers have also specified that the gas be generated at a sufficiently and reasonably low temperature so that the occupants of the car are not burned upon impacting an inflated air bag. If the gas produced is overly hot, there is a possibility that the occupant of the motor vehicle may be burned upon impacting a just deployed air bag. Accordingly, it is necessary that the combination of the gas generant and the construction of the air bag isolates automobile occupants from excessive heat. All of this is required while the gas generant maintains an adequate burn rate. In the industry, burn rates in excess of 0.5 inch per second (ips) at 1,000 psi, and preferably in the range of from about 1.0 ips to about 1.2 ips at 1,000 psi are generally desired.

Another related but important design criteria is that the gas generant composition produces a limited quantity of particulate materials. Particulate materials can interfere with the operation of the supplemental restraint system, present an inhalation hazard, irritate the skin and eyes, or constitute a hazardous solid waste that must be dealt with after the operation of the safety device. The latter is one of the undesirable, but tolerated in the absence of an acceptable alternative, aspects of the present sodium azide materials.

In addition to producing limited, if any, quantities of particulates, it is desired that at least the bulk of any such particulates be easily filterable. For instance, it is desirable that the composition produce a filterable, solid slag. If the solid reaction products form a stable material, the solids can be filtered and prevented from escaping into the surrounding environment. This also limits interference with the gas generating apparatus and the spreading of potentially harmful dust in the vicinity of the spent air bag which can cause lung, mucous membrane and eye irritation to vehicle occupants and rescuers.

Both organic and inorganic materials have also been proposed as possible gas generants. Such gas generant compositions include oxidizers and fuels which react at sufficiently high rates to produce large quantities of gas in a fraction of a second.

At present, sodium azide is the most widely used and accepted gas generating material. Sodium azide nominally meets industry specifications and guidelines. Nevertheless, sodium azide presents a number of persistent problems. Sodium azide is relatively toxic as a starting material, since its toxicity level as measured by oral rat $LD_{50}$ is in the range of 45 mg/kg. Workers who regularly handle sodium azide have experienced various health problems such as severe headaches, shortness of breath, convulsions, and other symptoms.

In addition, sodium azide combustion products can also be toxic since molybdenum disulfide and sulfur are presently the preferred oxidizers for use with sodium azide. The reaction of these materials produces toxic hydrogen sulfide gas, corrosive sodium oxide, sodium sulfide, and sodium hydroxide powder. Rescue workers and automobile occupants have complained about both the hydrogen sulfide gas and the corrosive powder produced by the operation of sodium azide-based gas generants.

Increasing problems are also anticipated in relation to disposal of unused gas-inflated supplemental restraint systems, e.g. automobile air bags, in demolished cars. The sodium azide remaining in such supplemental restraint systems can leach out of the demolished car to become a water pollutant or toxic waste. Indeed, some have expressed concern that sodium azide, when contacted with battery acids following disposal, forms explosive heavy metal azides or hydrazoic acid.

Sodium azide-based gas generants are most commonly used for air bag inflation, but with the significant disadvantages of such compositions many alternative gas generant compositions have been proposed to replace sodium azide. Most of the proposed sodium azide replacements, however, fail to deal adequately with each of the selection criteria set forth above.

One group of chemicals that has received attention as a possible replacement for sodium azide includes tetrazoles and triazoles. These materials are generally coupled with conventional oxidizers such as $KNO_3$ and $Sr(NO_3)_2$. Some of the tetrazoles and triazoles that have been specifically mentioned include 5-amino-tetrazole, 3-amino-1,2,4-triazole, 1,2,4-triazole, 1H-tetrazole, bitetrazole and several others. However, because of poor ballistic properties and high gas temperatures, none of these materials has yet gained general acceptance as a sodium azide replacement.

It will be appreciated, therefore, that there are a number of important criteria for selecting gas generating compositions for use in automobile supplemental restraint systems. For example, it is important to select starting materials that are not toxic. At the same time, the combustion products must not be toxic or harmful. In this regard, industry standards limit the allowable amounts of various gases produced by the operation of supplemental restraint systems.

It would, therefore, be a significant advancement in the art to provide compositions capable of generating large quantities of gas that would overcome the problems identified in the existing art. It would be a further advancement to provide gas generating compositions which are based on substantially nontoxic starting materials and which produce substantially nontoxic reaction products. It would be another advancement in the art to provide gas generating compositions which produce limited particulate debris and limited undesirable gaseous products. It would also be an advancement in the art to provide gas generating compositions which form a readily filterable solid slag upon reaction.

Such compositions and methods for their use are disclosed and claimed herein.

SUMMARY AND OBJECTS OF THE INVENTION

The novel solid compositions of the present invention include a non-azide fuel and an appropriate oxidizer. Specifically, the present invention is based upon the discovery that improved gas generant compositions are obtained using a bitetrazoleamine, or a salt or a complex thereof as a non-azide fuel. The presently preferred bitetrazoleamine is bis-(1(2)H-tetrazol-5-yl)-amine (hereinafter sometimes referred to as "BTA"), which has been found to be particularly suitable for use in the gas generating composition of the present invention. In particular, the compositions of the present invention are useful in supplemental restraint systems, such as automobile air bags.

The present compositions are capable of generating large quantities of gas while overcoming various problems associated with conventional gas generating compositions. The compositions of the present invention produce substantially nontoxic reaction products.

The present compositions are particularly useful for generating large quantities of a nontoxic gas, such as nitrogen gas. Significantly, the present compositions avoid the use of azides, produce no sodium hydroxide by-products, generate no sulfur compounds such as hydrogen sulfide and sulfur oxides, and still produce a nitrogen containing gas. The compositions of the present invention also produce only limited particulate debris, provide good slag formation and avoid, if not substantially avoid, the formation of nonfilterable particulate debris. At the same time, the compositions of the present invention achieve a relatively high burn rate, while producing a reasonably low temperature gas. Thus, the gas produced by the present invention is readily adaptable for use in deploying supplemental restraint systems, such as automobile air bags.

DETAILED DESCRIPTION OF THE INVENTION

Figure 1:
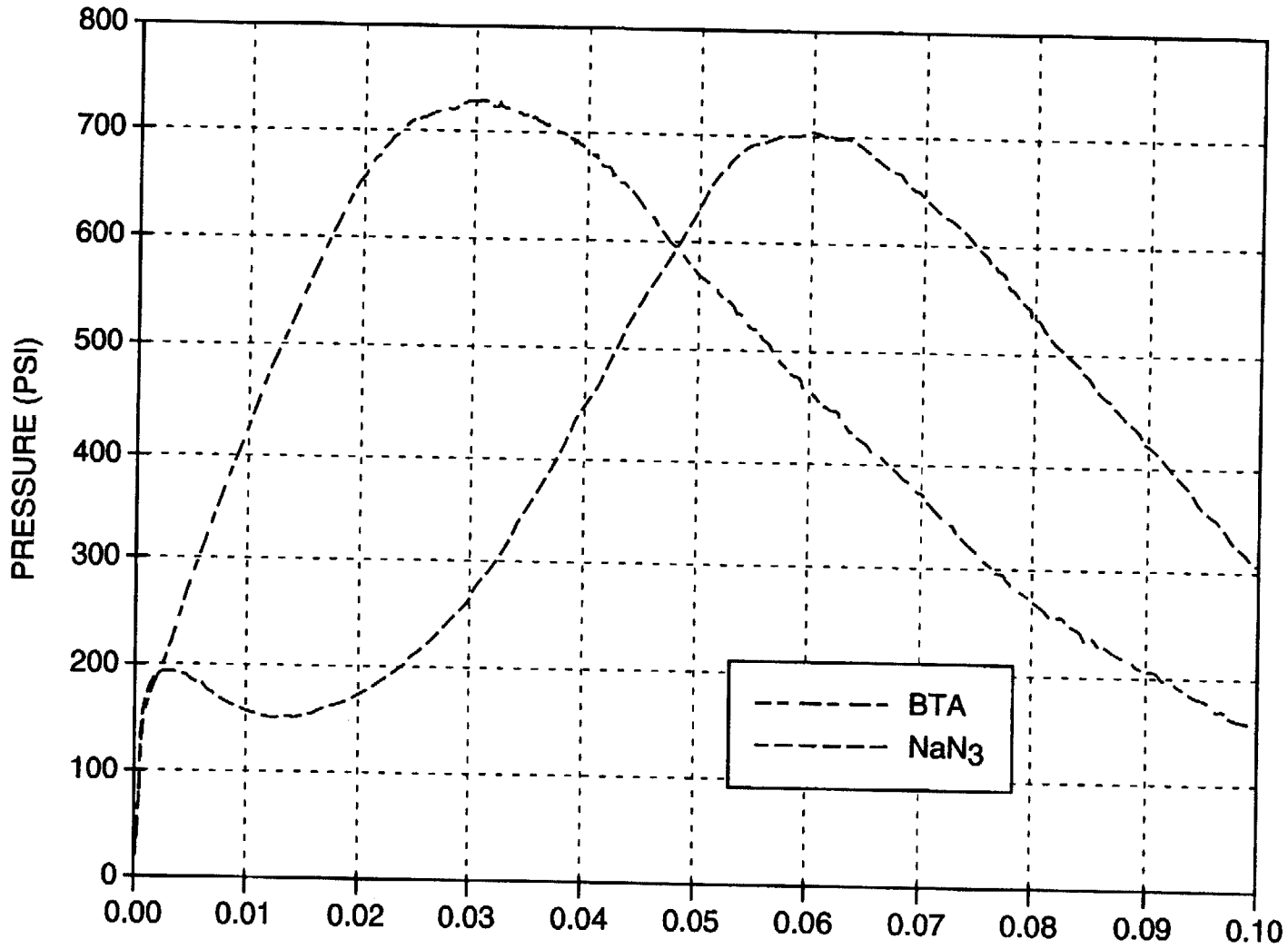
FIG. 1 is a graph illustrating the change in pressure over time within a combustion chamber during the reaction of compositions within the scope of the invention and a conventional sodium azide composition.

The present invention relates to the use of a bitetrazoleamine or a salt or a complex thereof as the primary fuel in a novel gas generating composition.

The bitetrazole-amines of the present invention have the following structure:

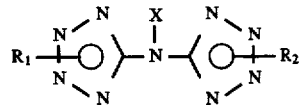

wherein X, $R_1$ and $R_2$, each independently, represent hydrogen, methyl, ethyl, cyano, nitro, amino, tetrazolyl, a metal from Group Ia, Ib, IIa, IIb, IIIa, IVb, VIb, VIIb or VIII of the Periodic Table (Merck Index (9th Edition 1976)), or a nonmetallic cation of a high nitrogen-content base.

The fuel of the present invention can also comprise a salt or a complex of a bitetrazoleamine, such as BTA, and these salts or complexes include those of transition metals such as copper, cobalt, iron, titanium, and zinc; alkali metals such as potassium and sodium; alkaline earth metals such as strontium, magnesium, and calcium; boron; aluminum; and nonmetallic cations such as ammonium, hydroxylammonium, hydrazinium, guanidinium, aminoguanidinium, diaminoguanidinium, triaminoguanidinium, or biguanidinium.

One preferred bitetrazoleamine has the formula:

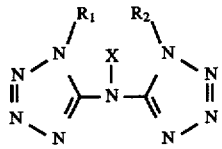

wherein $R_1$ and $R_2$ each independently represent hydrogen or a lower alkyl, such as methyl, and X represents hydrogen, methyl, cyano, nitro, amino and tetrazolyl. Preferably, the bitetrazoleamine is bis-(1(2)H-tetrazol-5-yl)-amine (BTA) in which $R_1$, $R_2$ and X are hydrogen. BTA tends to crystallize as the monohydrate or alcoholate. These latter forms of a bitetrazoleamine, such as BTA, also fall within the scope of the present invention.

In the compositions of the present invention, the fuel is paired with an appropriate oxidizer. Inorganic oxidizing agents are preferred because they produce a lower flame temperature and an improved filterable slag. Such oxidizers include metal oxides and metal hydroxides. Other oxidizers include a metal nitrate, a metal nitrite, a metal chlorate, a metal perchlorate, a metal peroxide, ammonium nitrate, ammonium perchlorate and the like. The use of metal oxides or hydroxides as oxidizers is particularly useful and such materials include for instance, the oxides and hydroxides of copper, cobalt, manganese, tungsten, bismuth, molybdenum, and iron, such as CuO, $Co_2O_3$, $Fe_2O_3$, $MOO_3$, $Bi_2MoO_6$, $Bi_2O_3$, and $Cu(OH)_2$. The oxide and hydroxide oxidizing agents mentioned above can, if desired, be combined with other conventional oxidizers such as $Sr(NO_3)_2$, $NH_4ClO_4$, and $KNO_3$, for a particular application, such as, for instance, to provide increased flame temperature or to modify the gas product yields.

A bitetrazoleamine, such as BTA, alone or in combination with a salt, complex or derivative thereof in accordance with the formula hereinabove can comprise the fuel in a gas generant composition according to the present invention. A bitetrazoleamine fuel, such as BTA or a BTA complex or salt or derivative, is combined, in a fuel-effective amount, with an appropriate oxidizing agent to obtain a present gas generating composition. In a typical formulation, the bitetrazoleamine fuel comprises from about 10 to about 50 weight percent of the composition and the oxidizer comprises from about 50 to about 90 weight percent thereof. More particularly, a composition can comprise from about 15 to about 35 weight percent fuel and from about 60 to about 85 weight percent oxidizer.

The present compositions can also include additives conventionally used in gas generating compositions, propellants, and explosives such as binders, burn rate modifiers, slag formers, release agents, and additives which effectively remove $NO_x$. Typical binders include lactose, boric acid, silicates including magnesium silicate, polypropylene carbonate, polyethylene glycol, and other conventional polymeric binders. Typical burn rate modifiers include $Fe_2O_3$, $K_2B_{12}$, $Bi_2MoO_6$, and graphite carbon fibers. A number of slag forming agents are known and include, for example, clays, talcs, silicon oxides, alkaline earth oxides, hydroxides, oxalates, of which magnesium carbonate, and magnesium hydroxide are exemplary. A number of additives and/or agents are also known to reduce or eliminate the oxides of nitrogen from the combustion products of a gas generant composition, including alkali metal salts and complexes of tetrazoles, aminotetrazoles, triazoles and related nitrogen heterocycles of which potassium aminotetrazole, sodium carbonate and potassium carbonate are exemplary. The composition can also include materials which facilitate the release of the composition from a mold such as graphite, molybdenum sulfide, or boron nitride.

A bitetrazoleamine fuel can be readily synthesized. For instance, BTA can be synthesized from relatively inexpensive bulk chemicals. BTA can be produced by conventional synthesis methods such as those discussed in Norris, et al., Cyanoguanyl Azide Chemistry, *Journal of Organic Chemistry*, 29: 650 (1964), the disclosure of which is incorporated herein by reference. Alternatively, the methods set forth in Examples 5 and 6, below, efficiently produce BTA.

Substituted bitetrazoleamine derivatives, such as substituted BTA derivatives, as are defined in the above general structure, can be prepared from suitable starting materials, such as substituted tetrazoles, according to techniques available to those skilled in the art. For instance, derivatives containing lower alkyl, such as methyl or ethyl, cyano, or tetrazolyl can be prepared by adapting the procedures described in *Journal of Organic Chemistry*, 29:650 (1964). Amino-containing derivatives can be prepared by adapting the procedures described in *Canadian Journal of Chemistry*, 47:3677 (1969), the disclosure of which is incorporated herein by reference. Nitro-containing derivatives can be prepared by adapting the procedures described in *Journal of the American Chemical Society*, 73:2327 (1951), the disclosure of which is incorporated herein by reference. Other radical-containing derivatives such as those containing ammonium, hydroxylammonium, hydrazinium, guanidinium, aminoguanidinium, diaminoguanidinium, triaminoguanidinium or biguanidinium radicals, can be prepared by adapting the procedures detailed in Boyer, *Nitroazoles, Organic Nitro Chemistry* (1986), the disclosure of which is incorporated by reference.

The present compositions produce stable pellets. This is important because gas generants in pellet form are generally used for placement in gas generating devices, such as automobile supplemental restraint systems. Gas generant pellets should have sufficient crush strength to maintain their shape and configuration during normal use. Pellet failure results in uncontrollable internal ballistics. The present composition formulations containing a fuel effective amount of BTA hydrate have crush strengths in excess of 100 pounds load at failure. This surpasses the crush strength normally observed with sodium azide formulations.

One of the important advantages of BTA in the gas generating compositions, a preferred embodiment of the present invention, is that it is stable and combusts to produce sufficient volumes of non-toxic gas products. BTA has also been found to be a safe material when subjected to conventional impact, friction, electrostatic discharge, and thermal tests. In this manner BTA meets the standards for safety in use as a gas generant in automobile air bags.

These BTA-containing compositions also are prone to form slag, rather than particulate debris. This is a further significant advantage in the context of gas generants for automobile air bags.

Theoretical gas yields and flame temperatures have been determined for a series of compositions within the scope of the invention. These compositions were comprised of BTA and one or more inorganic oxidizers, such as a metal oxide or hydroxide. In some cases, the oxidizer also included additional oxidizers and burn rate modifiers. The theoretical flame temperature and gas yield are compared to flame temperature and gas yield for a conventional sodium azide gas generant. Table 1 below sets forth the data obtained for each composition.

TABLE 1

| Composition (wt %) | Flame Temp (K.°) | Gas Yield Relative to Baseline* |
|---|---|---|
| Baseline (state-of-the-art) $NaN_3$ | 1452 | 1.00 |
| 20.8% BTA/64.8% CuO/4.4% $Sr(NO_3)_2$ | 1517 | 1.04 |
| 23.17% BTA/25.8% $Cu(OH)_2$/51.1% CuO | 1358 | 1.15 |
| 24.7% BTA/31.5% $Cu(OH)_2$/43.8% $Co_3O_4$ | 1031 | 1.19 |
| 22.8% BTA/59.3% CuO/17.9% $Co_3O_4$ | 1508 | 1.04 |
| 22.9% BTA/63.4% CuO/13.7% $Fe_2O_3$ | 1479 | 1.03 |
| 22.6% BTA/62.4% CuO/15.0% FeO(OH) | 1358 | 1.07 |
| 22.8% BTA/77.2% CuO | 1517 | 1.04 |

*Gas yield is normalized relative to a unit volume of azide-based gas generant. Baseline $NaN_3$ composition is 68% $NaN_3$/2% S/30% $MoS_2$.

As will be appreciated from Table 1, the present BTA gas generant compositions produce a volume of gas comparable to that produced by sodium azide. At the same time, the flame temperature is low enough so that the present compositions are suitable for use in environments such as automobile air bags provided that significant quantities of toxic reaction products are not produced. The primary gaseous reaction product is nitrogen, with lesser quantities of water and carbon dioxide.

An additional advantage of a BTA-fueled gas generant composition is that the burn rate performance is good. As mentioned above, burn rates above 0.5 inch per second (ips) are preferred. Ideally, burn rates are in the range of from about 1.0 ips to about 1.2 ips at 1,000 psi.

BTA-containing compositions of the present invention compare favorably with sodium azide compositions in terms of burn rate as illustrated in Table 2.

TABLE 2

| Composition | Burn Rate at 1,000 psi |
|---|---|
| 22.8% BTA/77.2% CuO | 1.08 ips |
| 21.4% BTA/77.5% CuO/1.1% $K_2B_{12}H_{12}$ | 1.38 ips |
| 22.8% BTA/77.2% CuO + 2.9% $H_2O$ | 0.706 ips |
| 47.6% BTA (Dipotassium salt)/52.4% $Sr(NO_3)_{32}$ | 0.554 ips |
| Baseline $NaN_3$ | 1.0 to 1.4 ips |

From the foregoing it will be appreciated that BTA represents an improvement over the state of the art of gas generating compositions. Production of harmful particulate materials is avoided using a bitetrazoleamine, such as BTA, as a fuel, while providing performance comparable to sodium azide compositions with respect to gas yield, flame temperature, and burn rate.

An inflatable restraining device, such as an automobile air bag system comprises a collapsed, inflatable air bag, a means for generating gas connected to that air bag for inflating the air bag wherein the gas generating means contains a nontoxic gas generating composition which comprises a fuel and an oxidizer therefor wherein the fuel comprises a bitetrazoleamine or a salt or complex thereof, having the formula

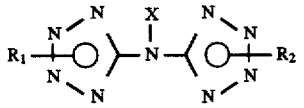

wherein X, $R_1$ and $R_2$, each independently, represent hydrogen, methyl, ethyl, cyano, nitro, amino, tetrazolyl, a metal from Group Ia, Ib, IIa, IIb, IIIa, IVb, VIb, VIIb or VIII of the Periodic Table (Merck Index (9th Edition 1976)), or an ammonium, hydroxyl ammonium, hydrazinium, guanidinium, aminoguanidinium, diaminoguanidinium, triaminoguanidinium, or biguanidinium cation. Suitable means for generating gas include gas generating devices which are used is supplemental safety restraint systems used in the automotive industry. The supplemental safety restraint system may, if desired, include conventional screen packs to remove particulates, if any, formed while the gas generant is combusted.

The present invention is further described in the following nonlimiting examples.

EXAMPLES

Example 1

A gas generating composition containing bis-(1(2)H-tetrazol-5-yl)-amine and copper oxide was prepared as follows. Cupric oxide powder (92.58 g, 77.16%) and bis-(1(2) H-tetrazol-5-yl)-amine (27.41 g, 22.84%) were slurried in 70 ml of water to form a thin paste. The resulting paste was then dried in vacuo (1 mm Hg) at 130° F. to 170° F. for 24 hours and pressed into pellets. The pellets were tested for burning rate, density, and mechanical crush strength. Burning rate was found to be 1.08 ips at 1,000 psi and the crush strength was found to be 85 pounds load at failure. The density of the composition was determined to be 3.13 g/cc.

Example 2

A gas generating composition containing bis-(1(2)H-tetrazol-5-yl)-amine, copper oxide, and water was prepared as follows. Cupric oxide powder (77.15 g, 77.15%) and bis-(1(2)H-tetrazol-5-yl)-amine (22.85 g, 22.85%) were slurried in 55 ml water to form a thin paste. The paste was dried in vacuo (1 mm Hg) at 150° F. to 170° F. until the moisture decreased to 25% of the total generant weight. The moist generant was forced through a 24 mesh screen and the resulting granules were dried at 150° F. to 170° F. for 24 hours. The dried material was exposed to 100% relative humidity ("RH") at 170° F. for 24 hours during which time 2.9% by weight of water was absorbed. The resulting composition was pressed into pellets, and the burning rate, mechanical crush strength, and density were determined. The burning rate was found to be 0.706 ips at 1,000 psi, the mechanical crush strength was found to be 137 pounds load at failure and the density was 3.107 g/cc.

Example 3

A BTA-containing composition having a CuO oxidizer prepared according the process of Example 1 was tested by combusting a multiple pellet charge in a ballistic test device. The test device comprised a combustion chamber equipped with a conventional 0.25 gram $BKNO_3$ igniter. The combustion chamber included a fluid outlet to a 13 liter tank. The test fixture was configured such that the environment of an automobile air bag was approximated.

After ignition and burning, a solid combustion residue was produced which remained as a solid mass. The residue retained the general shape of the original pellets. Both the weight and the appearance of the combustion slag pellets were consistent with calculated combustion products predicted to be principally copper metal and copper(I) oxide. Analysis of the gaseous products was further consistent with that predicted by calculational models and were primarily nitrogen, carbon dioxide and water.

Figure 2:
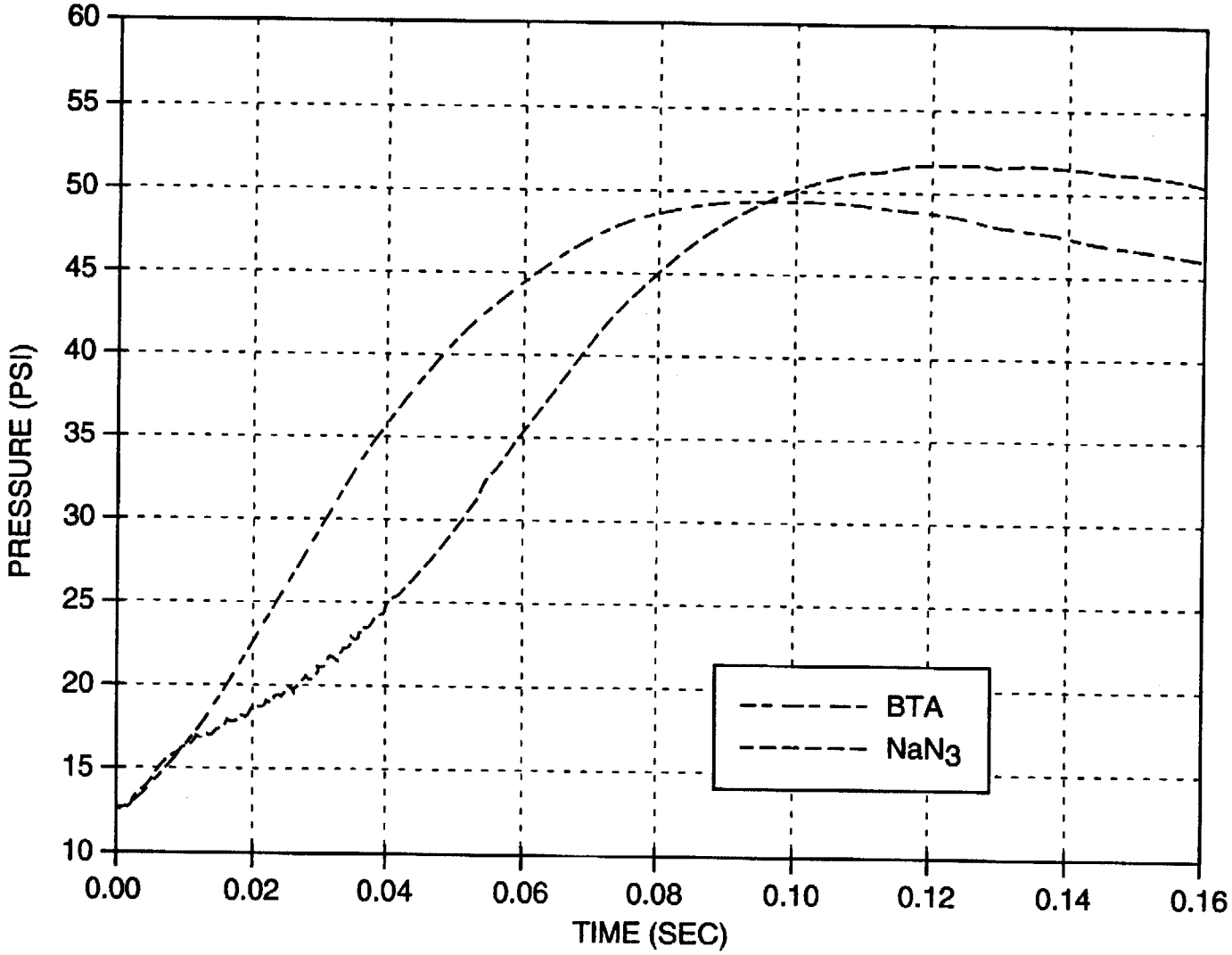
FIG. 2 is a graph illustrating the change in pressure over time within a 13 liter tank during the reaction of compositions within the scope of the invention and a conventional sodium azide composition.
Figure 3:
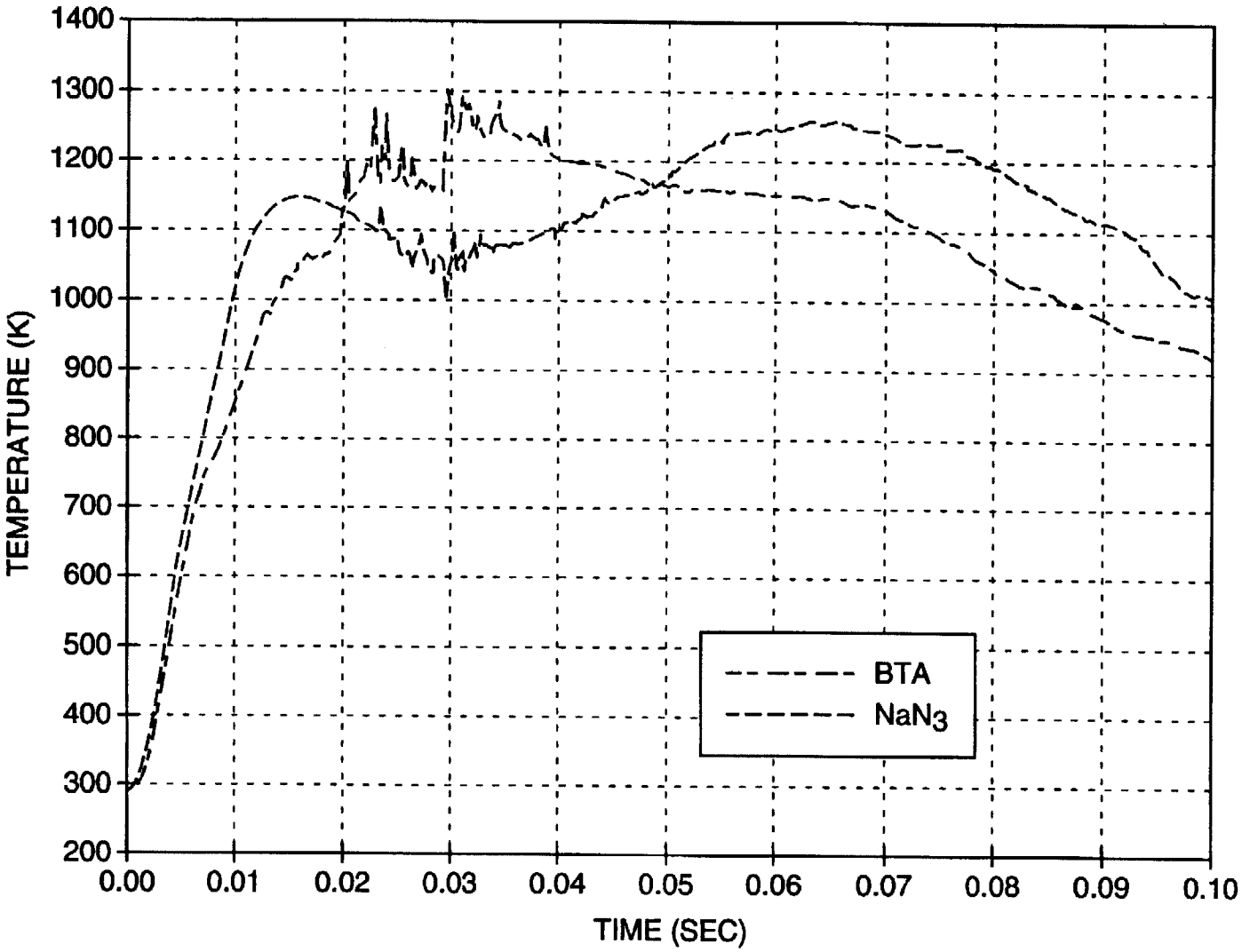
FIG. 3 is a graph illustrating the change in temperature over time for the reaction of compositions within the scope of the invention and conventional sodium azide composition.

The ballistic performance of the BTA/CuO (22.8% BTA/77.2% CuO) gas generant compares favorably to that of a conventional state-of-the-art (baseline) sodium azide gas generant (68% $NaN_3$/2% S/30% $MoS_2$). In comparison, the respective amounts of the BTA/CuO and the sodium azide compositions were selected to generate comparable volumes of gas products. FIGS. 1 through 3 graphically present the data obtained from these tests. FIG. 1 is a plot of the pressure achieved within the combustion chamber versus time. It can be seen that the present BTA-containing composition approximates the maximum pressure achieved by the conventional sodium azide composition, and reaches that pressure in a shorter period of time. As illustrated in FIG. 1 peak pressure is reached in 0.03–0.04 seconds.

FIG. 2 is a plot of pressure versus time in the tank during the reaction. This measurement is designed to predict the pressure curve which would be experienced in the actual air bag. Again, the BTA-containing composition closely approximates the performance of the conventional sodium azide composition.

FIG. 3 is a plot of temperature versus time. Once again, the present BTA-containing composition is comparable to the conventional sodium azide compositions.

Example 4

A composition prepared by the process described in Example 2 and containing 2.4% moisture was tested to determine its performance in inflating a standard 60-liter automotive air bag. This performance was compared to that of a conventional sodium azide gas generant composition in inflating a standard 60-liter automotive air bag. The results are set forth in Table III below:

TABLE III

| Composition | Weight of Charge (grams) | Time to Bag Inflation (msec) | Bag External Temperature (°F.) |
|---|---|---|---|
| Baseline in $NaN_3$ | 47 | 45 | 166 |
| BTA/CuO | 85 | 70 | 130 |

As shown in Table III, the desired acceptable inflation of the air bag was achieved with the BTA generant. The BTA-containing composition also produced lower temperatures on the bag surface than the sodium azide composition. Less fume and particulate materials were observed with the BTA-containing composition than with the sodium azide composition. With the BTA composition the solid residues and particulates were principally copper metal. With the sodium azide composition, the particulates were principally sodium hydroxide and sodium sulfide, both of which are corrosive and objectionable due to smell and skin irritation.

Example 5

Bis-(1(2)H-tetrazol-5-yl)-amine was prepared as follows. Sodium dicyanamide (18 g, 0.2 mole) was dissolved in water along with 27.3 g (0.42 mole) sodium azide and 38.3 g (0.4 mole) potassium acetate. The solution was heated to boiling and 0.4 mole acetic acid was added to the mixture over a 24-hour period. The solution was further diluted with water and treated with 44 g (0.2 mole) zinc acetate dihydrate resulting in the production of a white crystalline precipitate which was collected and washed with water. The precipitate was then slurried in water and treated with concentrated hydrochloric acid of approximately equal volume. After cooling, a white crystalline product was collected and dried. The solid was determined to be bis-(1(2)H-tetrazol-5-yl)-amine based on carbon 13 NMR spectroscopy and was recovered in a yield of ca. 70% based on dicyanamide.

Example 6

An alternative preparation of bis-(1(2)H-tetrazol-5-yl)-amine is set forth herein. Sodium dicyanamide (72 g, 0.8 mole), sodium azide (114 g, 1.76 moles) and ammonium chloride (94 g, 1.76 moles) were dissolved in about 800 ml water and refluxed for 20 hours. To this was added a solution of 0.8 mole zinc acetate dihydrate in water to form a white precipitate. The precipitate was collected, washed with water, and treated with a solution of 200 ml water and 400 ml concentrated hydrochloric acid for one hour at room temperature. The solids were collected, washed again with water, and then digested with 100 ml water and 600 ml concentrated hydrochloric acid at 90° C. The mixture was allowed to cool, producing a mass of white crystals which were collected, washed with water, and dried in vacuo (1 mm Hg) at 150° F. for several hours. A total of 80 grams (65% yield) of solid bis-(1(2)H-tetrazol-5-yl)-amine were collected as determined by carbon 13 NMR spectroscopy.

Example 7

This example illustrates a process of preparing BTA-metal complexes. A BTA/Cu complex was produced using the following starting materials:

| | FW | MMol. | gm. |
|---|---|---|---|
| BTA | 153 | 6.54 | 1.0 |
| $Cu(NO_3)_2.2.5H_2O$ | 232.6 | 6.54 | 1.52 |

The $Cu(NO_3)_2.2.5H_2O$ was dissolved in 20 ml of distilled water. The BTA was dissolved in 60 ml distilled water with warming. The solutions were combined, and a green precipitate was immediately observed. The precipitate was dried and recovered.

Example 8

This example illustrates a process of preparing BTA-metal complexes. A BTA/Zn complex was produced using the following starting materials:

| | FW | MMol. | gm. |
|---|---|---|---|
| BTA | 153 | 6.54 | 1.0 |
| $Zn(NO_3)_2.4H_2O$ | 261.44 | 6.54 | 1.71 |

The $Zn(NO_3)_2.4H_2O$ was dissolved in 20 ml of distilled water. The BTA was dissolved in 60 ml distilled water with warming. The solutions were combined, crystals were observed, and the material was collected and dried.

Example 9

For comparative purposes, gas generating compositions were prepared utilizing 5-aminotetrazole as fuel instead of BTA. Commercially obtained 5-aminotetrazol monohydrate was recrystallized from ethanol, dried in vacuo (1 mm Hg) at 170° F. for 48 hours and mechanically ground to a fine powder. Cupric oxide (15.32 g, 76.6%) and 4.68 g (23.4%) of the dried 5-aminotetrazole were slurried in 14 grams of water and then dried in vacuo (1 mm Hg) at 150° F. to 170° F. until the moisture content was approximately 25% of the total generant weight. The resulting paste was forced through a 24 mesh screen to granulate the mixture, which was further dried to remove the remaining moisture. A portion of the resulting dried mixture was then exposed to 100% relative humidity at 170° F. for 24 hours during which time 3.73% by weight of the moisture was absorbed. The above preparation was repeated on a second batch of material and resulted in 3.81% moisture being retained.

Pellets of each of the compositions were pressed and tested for burning rate and density. Burning rates of 0.799 ips at 1,000 psi were obtained for the anhydrous composition, and burning rates of 0.395 ips at 1,000 psi were obtained for the hydrated compositions. Densities of 3.03 g/cc and 2.82 g/cc were obtained for the anhydrous and hydrated compositions respectively.

The burning rate and density characteristics obtained with the BTA-containing compositions of Examples 1 and 2 in accordance with the present invention show advantages due to the use of BTA, particularly with respect to burning rate, of 1.08 ips and 0.706 ips at 1,000 psi, for the anhydrous and hydrated compositions, respectively. In addition, the BTA compositions of the present invention exhibit higher densities than the aminotetrazole compositions, and a lower capacity for moisture retention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A solid gas generating composition comprising a fuel and an oxidizer therefor, said fuel comprising a bitetrazoleamine or a salt or complex thereof, having the formula

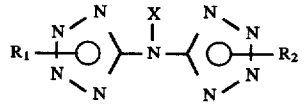

wherein X, $R_1$ and $R_2$, each independently, represent hydrogen, methyl, ethyl, cyano, nitro, amino, tetrazolyl, a metal from Group Ia, Ib, IIa, IIb, IIIa, IVb, VIb, VIIb or VIII of the Periodic Table (Merck Index (9th Edition 1976)), or a nonmetallic cation of a high nitrogen-content base, and said oxidizer consisting essentially of metal oxides, metal hydroxides, or mixtures thereof.

2. The solid gas generating composition according to claim 1 wherein $R_1$, $R_2$, and X are hydrogen.

3. The solid gas generating composition according to claim 1 wherein X, $R_1$, or $R_2$, is selected from the group consisting of ammonium, hydroxylammonium, hydrazinium, guanidinium, aminoguanidinium, diaminoguanidinium, triaminoguanidinium, and biguanidinium.

4. The solid gas generating composition according to claim 1 wherein at least one of X, $R_1$, and $R_2$ is a metal.

5. The solid gas generating composition according to claim 4 wherein said metal is a transition metal.

6. The solid gas generating composition according to claim 4 wherein said metal is selected from the group consisting of cobalt, copper, iron, potassium, sodium, strontium, magnesium, calcium, boron, aluminum, titanium and zinc.

7. The solid gas generating composition according to claim 1 wherein said bitetrazoleamine is bis(1(2)H-tetrazol-5-yl)-amine.

8. The solid gas generating composition according to claim 1 wherein said oxidizer is a transition metal oxide or a transition metal hydroxide.

9. The solid gas generating composition according to claim 1 wherein said oxidizer is an oxide or hydroxide of a metal selected from the group consisting of copper, molybdenum, bismuth, cobalt and iron.

10. Th& solid gas generating composition according to claim 1 which also includes a secondary oxidizer selected from the group consisting of a metal nitrate, a metal nitrite, a metal peroxide, a metal carbonate, a metal chlorate, a metal perchlorate, ammonium nitrate, and ammonium perchlorate.

11. The solid gas generating composition comprising a fuel selected from the group consisting of bis-(1(2)H-tetrazol-5-yl)-amine, a salt thereof, a complex thereof, and a mixture thereof, and an oxidizer, said oxidizer consisting essentially of at least the of a metal oxide and a metal hydroxide.

12. The solid gas generating composition according to claim 11 wherein said metal oxide or said metal hydroxide is a transition metal oxide or a transition metal hydroxide.

13. The solid gas generating composition according to claim 11 wherein said oxidizer is an oxide or hydroxide of a metal selected from the group consisting of copper, molybdenum, bismuth, cobalt and iron.

14. The solid gas generating composition according to claim 11 wherein said fuel is present in an amount ranging from about 10 to about 40 percent by weight, and said oxidizer is present in an amount ranging from about 90 to about 60 percent by weight.

15. The solid gas generating composition according to claim 11 wherein said salt or complex of bis-(1(2)H-tetrazol-5-yl)-amine is a transition metal salt or complex thereof.

16. The solid gas generating composition according to claim 11 wherein said salt or complex of bis-(1(2)H-tetrazol-5-yl)-amine is a salt or complex of a metal selected from the group consisting of iron, boron, copper, cobalt, zinc, potassium, sodium, strontium, and titanium.

17. The solid gas generating composition according to claim 11 which also includes a burn rate modifier.

18. The solid gas generating composition according to claim 14 which also includes a binder.

19. The solid gas generating composition according to claim 14 which also includes a slag forming agent.

20. An automobile air bag system comprising: a collapsed, inflatable air bag; and a gas generating device connected to said air bag for inflating said air bag, said gas generating device containing a gas generating composition comprising a fuel and an oxidizer therefor, said fuel comprising a bitetrazoleamine or a salt or complex thereof, having the formula

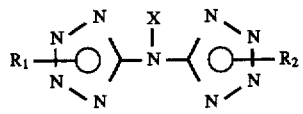

wherein X, $R_1$ and $R_2$, each independently, represent hydrogen, methyl, ethyl, cyano, nitro, amino, tetrazolyl, a metal from Group Ia, Ib, IIa, IIb, IIIa, IVb, VIb, VIIb or VIII of the Periodic Table (Merck Index (9th Edition 1976)), or a nonmetallic cation of a high nitrogen-content base; and said oxidizer consisting essentially of metal oxides, metal hydroxides, or mixtures thereof.

21. The automobile air bag system according to claim 20 where $R_1$, $R_2$, and X are hydrogen.

22. The automobile air bag system according to claim 20 wherein at least one of X, $R_1$, and $R_2$ is a metal.

23. The automobile air bag system according to claim 22 wherein said metal is a transition metal.

24. The automobile air bag system according to claim 22 wherein said metal is selected from the group consisting of iron, copper, cobalt, zinc, potassium, sodium, strontium, and titanium.

25. The automobile air bag system according to claim 22 wherein X, $R_1$, or $R_2$, is selected from the group consisting of ammonium, hydroxylammonium, hydrazinium, guanidinium, aminoguanidinium, diaminoguanidinium, triaminoguanidinium, and biguanidinium.

26. The automobile air bag system according to claim 20 wherein said fuel is bis-(1(2)H-tetrazol-5-yl)-amine and is present in said gas generating composition in an amount ranging from about 10 to about 50 percent by weight of said gas generating composition.

27. The automobile air bag system according to claim 20 wherein said metal oxide or said metal hydroxide is a transition metal oxide or a transition metal hydroxide.

28. The automobile air bag system according to claim 27 wherein said oxidizer is an oxide or hydroxide of a metal selected from the group consisting of copper, molybdenum, bismuth, cobalt and iron.

29. The automobile air bag system according to claim 20 wherein said gas generating composition also includes a secondary oxidizer selected from the group consisting of a metal nitrate, a metal nitrite, a metal peroxide, a metal carbonate, a metal chlorate, a metal perchlorate, ammonium nitrate, and ammonium perchlorate.

30. The solid gas generating composition according to claim 1 wherein the bitetrazoleamine is present in an amount ranging from about 10 to about 50 weight percent thereof.

31. The solid gas generating composition according to claim 1 wherein the nonmetallic cation is an ammonium, hydroxyl ammonium, hydrazinium, guanidinium, aminoguanidinium, diaminoguanidinium, triaminoguanidinium, or biguanidinium cation.

32. An automobile air bag system according to claim 20 wherein the nonmetallic cation is an ammonium, hydroxyl ammonium, hydrazinium, guanidinium, aminoguanidinium, diaminoguanidinium, triaminoguanidinium, or biguanidinium cation.

33. A vehicle containing a supplemental restraint system having an air bag system comprising:

a collapsed inflatable air bag and a gas generating device connected to said air bag for inflating said air bag, said gas generating device containing a solid gas generating composition comprising a fuel and an oxidizer therefor, said fuel comprising a bitetrazoleamine or a salt or complex thereof, having the formula

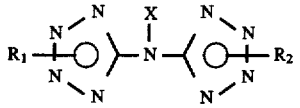

wherein X, $R_1$ and $R_2$, each independently, represent hydrogen, methyl, ethyl, cyano, nitro, amino, tetrazolyl, a metal from Group Ia, Ib, IIa, IIb; IIIa, IVb; VIb, VIIb or VIII of the Periodic Table (Merck Index (9th Edition 1976)), or a nonmetallic cation of a high nitrogen-content base, and said oxidizer consisting essentially of metal oxides, metal hydroxides, or mixtures thereof.

34. The solid gas generating composition according to claim 11, which also includes a secondary oxidizer selected from the group consisting of metal nitrates, metal nitrites, metal peroxides, metal carbonates, metal chlorates, metal perchlorates, ammonium nitrate, and ammonium perchlorate.

* * * * *